US010871171B2

(12) United States Patent
Nara et al.

(10) Patent No.: US 10,871,171 B2
(45) Date of Patent: Dec. 22, 2020

(54) CENTRIFUGAL FAN DESIGN TO DECREASE NOISE AND SLIM DOWN THE FAN

(71) Applicant: MINEBEA MITSUMI INC., Nagano (JP)

(72) Inventors: Kiyohisa Nara, Fukoroi (JP); Seiya Fujimoto, Fukoroi (JP)

(73) Assignee: MINEBEA MITSUMI INC., Nagano (JP)

( * ) Notice: Subject to any disclaimer, the term of this patent is extended or adjusted under 35 U.S.C. 154(b) by 213 days.

(21) Appl. No.: 15/475,711

(22) Filed: Mar. 31, 2017

(65) Prior Publication Data

US 2017/0284420 A1 Oct. 5, 2017

(30) Foreign Application Priority Data

Apr. 5, 2016 (JP) ..... 2016-075737

(51) Int. Cl.

| | |
|---|---|
| ***F04D 29/66*** | (2006.01) |
| ***F04D 25/06*** | (2006.01) |
| ***F04D 29/16*** | (2006.01) |
| ***F04D 17/16*** | (2006.01) |
| ***F04D 29/28*** | (2006.01) |
| ***F04D 29/42*** | (2006.01) |

(52) U.S. Cl.

CPC ..... *F04D 29/666* (2013.01); *F04D 17/16* (2013.01); *F04D 25/0613* (2013.01); *F04D 25/0693* (2013.01); *F04D 29/162* (2013.01); *F04D 29/281* (2013.01); *F04D 29/4226* (2013.01)

(58) Field of Classification Search

CPC .. F04D 29/666; F04D 29/162; F04D 25/0613; F04D 29/281; F04D 25/0693; F04D 29/4226; F04D 17/16

USPC ..... 416/183

See application file for complete search history.

(56) References Cited

U.S. PATENT DOCUMENTS

2008/0106867 A1* 5/2008 Abe ..... F04D 25/082 361/695

2014/0010682 A1* 1/2014 Suzuki ..... F04D 29/666 417/354

(Continued)

FOREIGN PATENT DOCUMENTS

JP S63-192993 A 8/1988

JP 2001-132686 A 5/2001

(Continued)

OTHER PUBLICATIONS

Jul. 20, 2018 Office Action issued in Japanese Patent Application No. 2016-075737.

*Primary Examiner* — Christopher S Bobish

(74) *Attorney, Agent, or Firm* — Oliff PLC

(57) ABSTRACT

A centrifugal fan comprises a rotor that has a rotor yoke, an impeller that has a blade and is coupled to the outer periphery of the rotor yoke, a motor that rotates the rotor and a casing that has a suction opening and a discharge opening, and houses the rotor, the impeller, and the motor. The impeller rotating together with the rotor discharges air sucked in through the suction opening to the outside of the casing through the discharge opening. An inner periphery part of the blade on the rotor yoke side extends to the inner periphery side, in such a manner as to overlap with an outer peripheral surface of the rotor yoke in the axial direction of the motor.

4 Claims, 8 Drawing Sheets

(56) References Cited

U.S. PATENT DOCUMENTS

| | | | | |
|---|---|---|---|---|
| 2014/0286761 | A1* | 9/2014 | Kim | F04D 29/162<br>415/173.1 |
| 2014/0294582 | A1* | 10/2014 | Fujioka | F04D 25/02<br>415/228 |
| 2015/0118037 | A1 | 4/2015 | Otsuka et al. | |
| 2015/0152883 | A1* | 6/2015 | Dybenko | F04D 25/0613<br>415/220 |

FOREIGN PATENT DOCUMENTS

| | | | |
|---|---|---|---|
| JP | 2003-284288 | A | 10/2003 |
| JP | 2012-207600 | A | 10/2012 |
| JP | 2015-86721 | A | 5/2015 |

* cited by examiner

CENTRIFUGAL FAN DESIGN TO DECREASE NOISE AND SLIM DOWN THE FAN

CROSS REFERENCE TO RELATED APPLICATIONS

This application claims the benefit of Japanese Patent Application No. 2016-075737, filed Apr. 5, 2016, which is hereby incorporated by reference in its entirety.

BACKGROUND

Technical Field

The present disclosure relates to a centrifugal fan, and specifically to a technique of slimming down the fan.

Background

A centrifugal fan is known as a fan widely used for cooling household electric appliances, office automation equipment, and industrial machinery, ventilation, air-conditioning, vehicle air-conditioning, air blowing, and other purposes. A conventionally known centrifugal fan (see Japanese Patent Application Laid-Open No. 2012-207600, for example) has a casing comprised of an upper casing and a lower casing, and an impeller is housed between the upper casing and the lower casing. The centrifugal fan sucks in air through a suction opening by rotation of the impeller, and discharges it to the outside through discharge openings formed in side surfaces between the upper casing and the lower casing.

FIG. 8 is a centrifugal fan 100 described in Japanese Patent Application Laid-Open No. 2012-207600. A square casing 120 is configured of an upper casing 121 and a lower casing 122, and an impeller 130 is housed between the upper casing 121 and the lower casing 122. The impeller 130 includes an annular shroud 131. Air sucked in through a suction opening 110 by high-speed rotation of the impeller 130 passes through between blades 135, is blown out from the outer periphery of the impeller 130, and is discharged to the outside through discharge openings 111 formed in side surfaces between the upper casing 121 and the lower casing 122.

When attaching a centrifugal fan configured as in Japanese Patent Application Laid-Open No. 2012-207600 to a narrow space, the axial dimension, that is, the overall height of the centrifugal fan needs to be reduced to be slimmed down. However, this also slims down the impeller, whereby the cross-sectional area of a flow path on the suction side of the impeller is reduced, and air-flow resistance increases. Hence, noise is increased.

The present disclosure is related to providing a centrifugal fan that can suppress increase in noise, even after slimming down the fan.

SUMMARY

According to an aspect of the present disclosure, a centrifugal fan includes: a rotor that has a rotor yoke; an impeller that has a blade and is coupled to the outer periphery of the rotor yoke; a motor that rotates the rotor; and a casing that has a suction opening and a discharge opening, and houses the rotor, the impeller, and the motor, the impeller rotating together with the rotor discharging air sucked in through the suction opening to the outside of the casing through the discharge opening, an inner periphery part of the blade on the rotor yoke side extends to the inner periphery side, in such a manner as to overlap with an outer peripheral surface of the rotor yoke in the axial direction of the motor.

According to the present disclosure, by extending the inner periphery part of the blade of the impeller to the inner periphery side such that it overlaps with the outer peripheral surface of the rotor yoke as described above, the chord length of the blade can be made longer than when the inner periphery part is not extended in an impeller having the same outer diameter. The increase in the chord length of the blade reduces load on the blade during operation. Consequently, increase in noise can be suppressed even after thinning down the impeller. Additionally, since the chord length of the blade is increased, capacity is increased efficiently, and the capacity property can be improved.

In one aspect of the present disclosure, a surface of the inner periphery part of the blade opposite the outer peripheral surface of the rotor yoke is formed along the outer peripheral surface; and a certain clearance is formed between the opposite surface and the outer peripheral surface. Preferably, to minimize noise, the clearance is constant and is within a range of 0.75 to 1.5 mm. In one aspect of the present disclosure, the inner periphery part of the blade is substantially ⅓ of a chord length of the blade.

Also, in one aspect of the present disclosure, an axial height of the inner periphery part of the blade is substantially the same or lower than an axial height of the rotor yoke. This aspect prevents air having flowed in through the suction opening from contacting the inner periphery part of the blade and causing noise.

The present disclosure has an effect of providing a centrifugal fan that can suppress increase in noise, even after slimming down the fan.

DETAILED DESCRIPTION

Hereinafter, an embodiment of the present disclosure will be described with reference to the accompanying drawings.

[1] Basic Configuration of Centrifugal Fan

Figure 1:
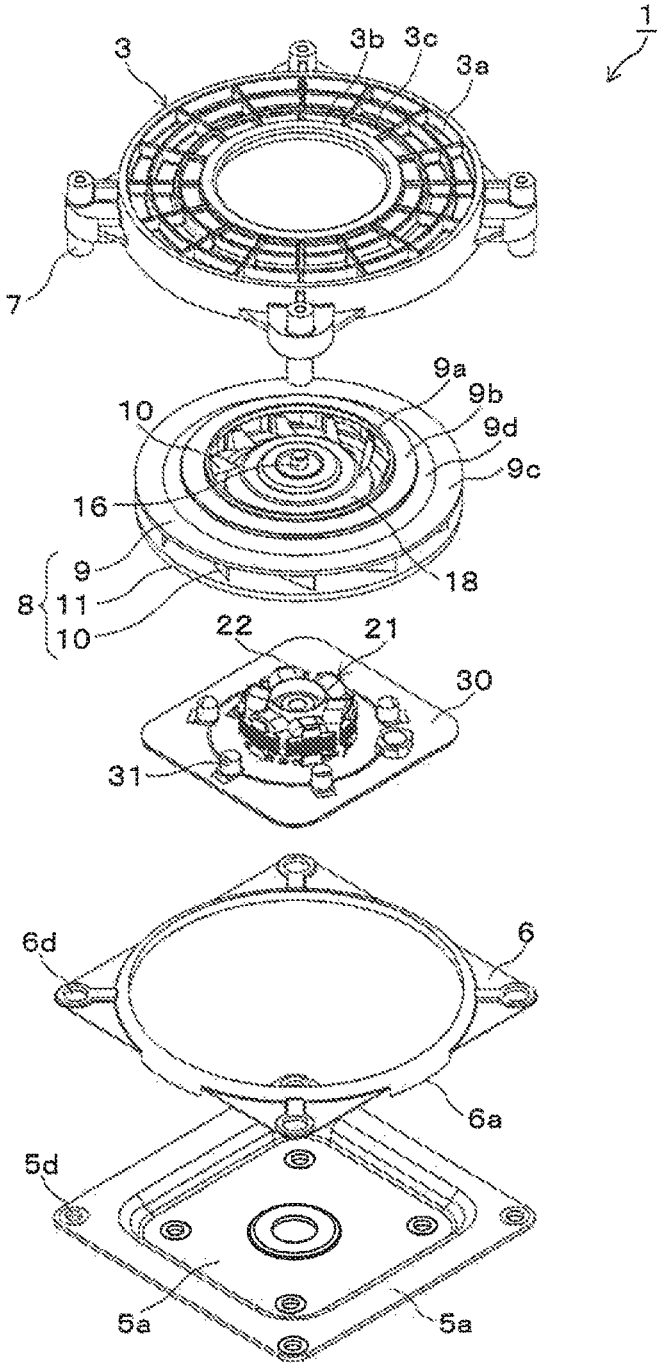
FIG. 1 is an exploded perspective view of a centrifugal fan of an embodiment of the present disclosure.
Figure 2:
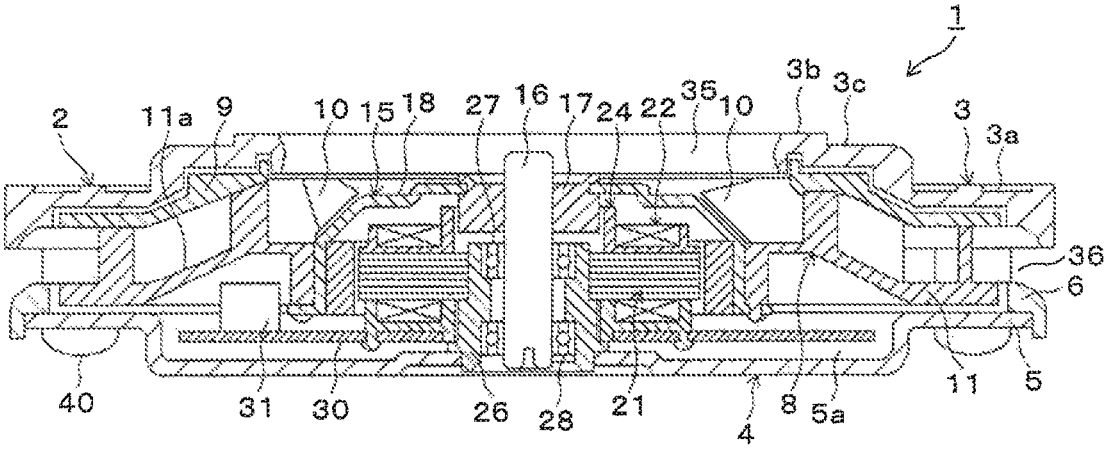
FIG. 2 is a cross-sectional view of the centrifugal fan.
Figure 3:
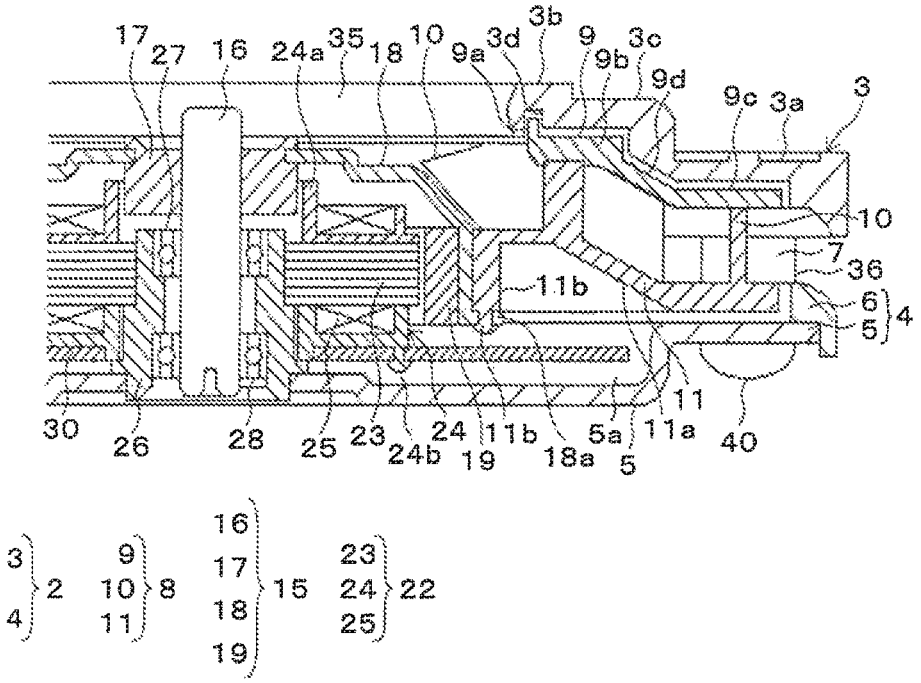
FIG. 3 is a partial enlargement of FIG. 2.

FIGS. 1 and 2 show a centrifugal fan 1 of an embodiment. FIG. 3 is a partial enlargement of FIG. 2. The basic configuration of the centrifugal fan 1 is substantially the same as the configuration described in Japanese Patent Application Laid-Open No. 2012-207600. The centrifugal fan 1 includes a casing 2, a motor 21 housed inside the casing 2, and an impeller 8 housed inside the casing 2 and rotated by the motor 21.

The casing 2 is comprised of an annular upper casing 3 and a rectangular lower casing 4. The impeller 8 is rotatably housed between the upper casing 3 and the lower casing 4. Rotation of the impeller 8 sucks air into the impeller 8 through a suction opening 35 formed in the upper casing 3. The air passes through between blades 10 of the impeller 8, and is discharged to the outside (to the radially outer side) of the casing 2 through discharge openings 36 formed in side surfaces of the casing 2. The discharge openings 36 are formed between multiple (four in this case) cylindrical struts 7 interposed between the upper and lower casings 3, 4.

The lower casing 4 is configured of a metal (e.g., a steel plate) motor base 5 having a rectangular recess 5*a* formed in its center part and a resin base plate 6, which are placed on top of one another. A substantially tubular bearing holding portion 26 is fixed to the center of the motor base 5. A shaft 16 as a rotation axis is rotatably supported to the inner side of the bearing holding portion 26, through bearings 27, 28.

As shown in FIGS. 2 and 3, the motor 21 which is an outer rotor type brushless DC motor is attached to a bottom surface of the recess 5*a* of the motor base 5. The motor 21 includes a lower insulator 24*b* that constitutes a later mentioned insulator 24, and a circuit board 30 is fixed to a lower surface of the lower insulator 24*b*. The circuit board 30 is joined to the lower insulator 24*b*, by thermal caulking on the tip ends of multiple pins that are formed integrally with the lower insulator 24*b* and protruding downward.

A stator 22 that constitutes the motor 21 is fixed to the outer side of the bearing holding portion 26. The stator 22 is configured of: a stator core 23 formed by laminating a certain number of sheet cores such as steel sheets made of a soft magnetic material; the insulator 24 configured of an upper insulator 24*a* and the lower insulator 24*b* made of resin and attached to the stator core 23 from both sides in the axial direction; and a coil 25 wound around teeth of the stator core 23 through the insulator 24.

The sheet core constituting the stator core 23 includes multiple teeth (six in FIG. 1) extending radially outward from an annular yoke, and multiple cores are laminated to form the stator core 23. An opening is formed in the center of the stator core 23, and the bearing holding portion 26 is fitted into the opening. A lower part of the stator 22 (lower side of coil 25) and the circuit board 30 are housed inside the recess 5*a* of the motor base 5. This reduces the axial dimension, that is, slims down the configuration.

As shown in FIG. 1, downwardly extending side portions 6*a* are formed in four parts on the outer peripheral edge of the base plate 6. The motor base 5 and the base plate 6 are located with respect to each other, by bringing the inner side of the side portions 6*a* into contact with the outer periphery of four sides of the motor base 5.

The motor 21 is configured of the stator 22 and a rotor 15. As shown in FIGS. 2 and 3, the rotor 15 is configured of: the shaft 16; a boss portion 17 attached to the shaft 16; a cylindrical cup-like rotor yoke 18 fixed to the boss portion 17 by caulking; and an annular magnet 19 fastened to the inner side of the rotor yoke 18.

Figure 5:
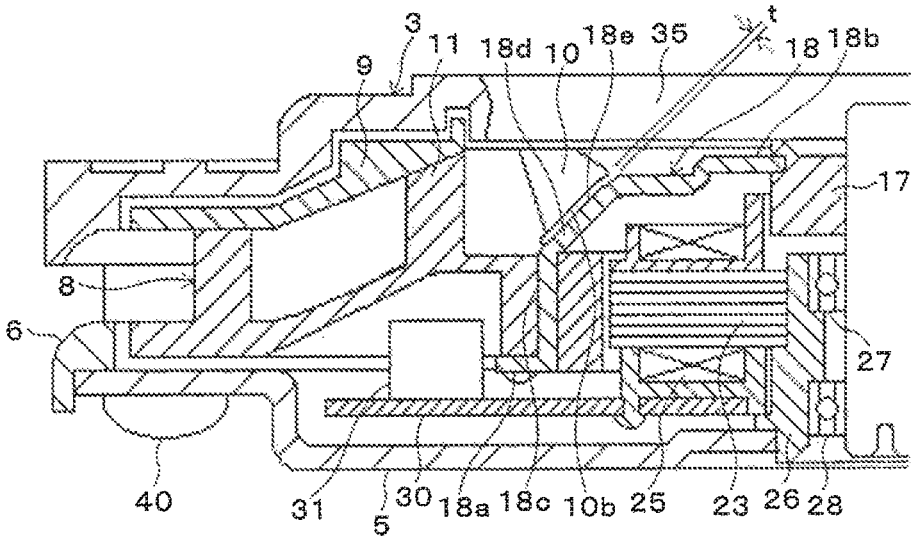
FIG. 5 is a partial enlargement of a cross section of the centrifugal fan, and is a diagram showing a clearance between a lower surface of an inner periphery part of a blade of the impeller and an outer peripheral surface of a rotor yoke.

As shown in FIG. 5, the rotor yoke 18 includes: a disc-like top plate portion 18*b* fixed to the boss portion 17; a cylindrical body portion 18*c*; and a conical portion 18*d* connecting the top plate portion 18*b* and the body portion 18*c*, and tilted downward toward the outer periphery of the rotor yoke 18. A flange 18*a* protruding radially outward is formed at the lower end of the body portion 18*c*. The rotor 15 is driven by the motor 21 and rotates relative to the stator 22.

Figure 4:
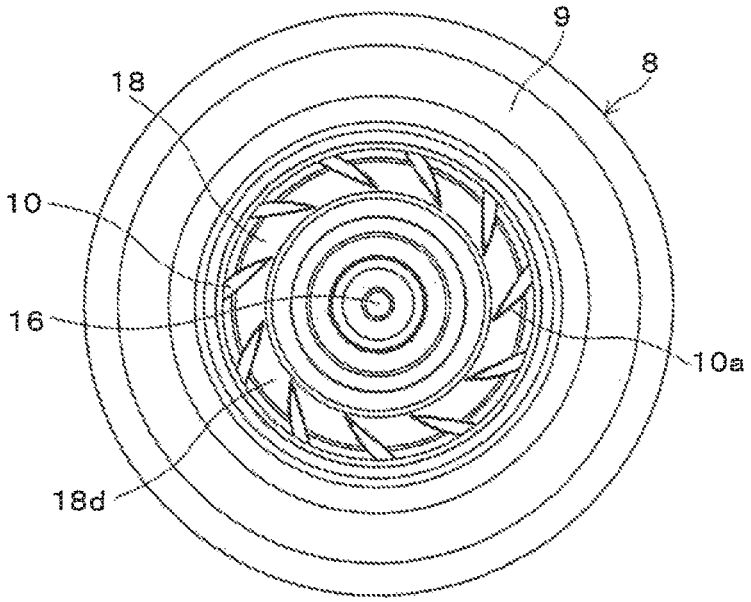
FIG. 4 is a plan view of an impeller included in the centrifugal fan.

The impeller 8 coupled to the rotor 15 is configured of an annular shroud 9, the multiple blades 10, and a disc-like main plate 11. FIG. 4 is a plan view (view from top) of the impeller 8. The blades 10 and the main plate 11 are molded in one piece from resin, and are joined to the shroud 9.

The blades 10 stand in the axial direction from the main plate 11. The blades 10 are curved and tilted rearward with respect to the rotation direction, and have a structure in which the blades face the rear with respect to the rotation direction (so-called turbo type). The blades 10 all have the same shape, and the blades 10 and the shroud 9 are joined by welding, for example. Note that the impeller 8 may be formed by co-injection molding using different resin materials.

As shown in FIG. 3, a first annular step 9*b* and a second annular step 9*c* are formed on an upper surface of the shroud 9. The steps 9*b*, 9*c* are substantially flat, and a tilted surface 9*d* is formed between the steps 9*b*, 9*c*. An annular step 9*a* is formed on the axial upper end of the shroud 9, and the annular step 9*a* fits into an annular groove 3*d* formed in a lower surface of the upper casing 3.

The main plate 11 of the impeller 8 has an inner periphery part and an outer periphery part, and the inner periphery part is positioned higher in the axial direction than the outer periphery part. The inner periphery part and the outer periphery part are connected by a tilted portion 11*a*. The blades 10 stands from the outer periphery part. Additionally, an inner cylinder portion 11*b* is vertically suspended at the innermost part of the main plate 11. The body portion 18*c* of the rotor yoke 18 is fastened to the inner side of the inner cylinder portion 11*b*, whereby the impeller 8 is coupled integrally with the rotor 15 to be rotatable therewith.

As shown in FIG. 3, multiple pins 11*b* are formed on the lower end of the inner cylinder portion 11*b* of the main plate 11. The rotor yoke 18 and the main plate 11 are joined by fitting the pins 11*b* into through holes formed in the flange 18*a* of the rotor yoke 18, and performing thermal caulking or infrared caulking on the tip ends of the pins 11*b* protruding from the flange 18*a*. Thus, the rotor 15 and the impeller 8 are coupled as one piece. Specifically, the impeller 8 rotates around the shaft 16, together with the rotor 15 rotated by the motor 21.

As shown in FIG. 1, multiple recesses 3*a* (relief portions) are formed on the upper surface side of the upper casing 3. The struts are formed in multiple evenly divided parts (four in this case) of the circumference of the outer periphery of the upper casing 3. The struts 7 and the upper casing 3 are molded in one piece from resin. Meanwhile, through holes 5*d*, 6*d* are formed in four corners, which are parts corresponding to the struts 7, of the rectangular motor base 5 and the base plate 6 that constitute the lower casing 4. The upper casing 3 and the lower casing 4 are coupled by inserting tapping screws 40 (see FIG. 2) through the through holes 5*d*, 6*d* from below, and screwing and fastening tip end parts thereof into the cylindrical struts 7. Note that fastening means is not limited to this, and a bolt inserted into the strut 7 from the lower casing 4 side may be tightened by a nut from the upper casing 3 side, for example.

As shown in FIGS. 1 and 2, electronic components 31 such as parts and a control IC for driving and controlling the motor 21 are mounted on the circuit board 30. Hence, the tilted portion 11*a* is formed in the main plate 11 to prevent contact between the electronic components 31 and the impeller 8 within a limited space. Since the electronic components 31 are partially housed in the position of the tilted portion 11*a*, it is possible to prevent contact between the electronic components 31 and the impeller 8, and the structure can be slimmed down.

An opening as the suction opening 35 is formed in the center of the upper casing 3. As shown in FIG. 3, at the edge of the suction opening 35 of the upper casing 3, two steps which are an outer step 3*c* and an inner step 3*b*, which protrude axially upward toward the suction opening 35 from an upper surface of the outer periphery of the upper casing 3 where the recesses 3*a* are formed, are formed in a stepped manner. These steps 3*c*, 3*b* are used when attaching the centrifugal fan 1 to an attachment target. Specifically, the outer step 3*c* and the inner step 3*b* are fitted into an attachment hole or a duct formed in the attachment target (e.g., an apparatus or a housing of a machine) as a spigot, to locate the centrifugal fan 1.

[2] Characteristics of Present Disclosure

Next a concrete example showing the characteristics of the present disclosure will be described.

If the impeller 8 is slimmed down in the centrifugal fan 1 having the basic structure described above, the cross-sectional area of a flow path on the suction side of the impeller 8 is reduced, and air-flow resistance increases. This increases noise. Therefore, by increasing the chord length of the blade 10 of the impeller 8, load on the blade 10 can be reduced to improve the capacity property and reduce noise. At this time, if the dimension of the outer diameter of the impeller 8 is limited, the blade 10 may be extended to the inner periphery side. However, there is a problem that when joining the impeller 8 with the rotor yoke 18, the joining structure between the rotor yoke 18 and the blade 10 extended to the inner periphery side becomes complex. Hence, in the present embodiment, the relation between the blade 10 and the rotor yoke 18 when extending the blade 10 to the inner periphery side is set in the following manner.

As shown in FIG. 5, an inner periphery part (hereinafter referred to as inner periphery portion 10*a*) of the blade 10 of the impeller 8 extends to the inner periphery side, such that it overlaps with an outer peripheral surface of the rotor yoke 18 in the axial direction. That is, in this case, the inner periphery portion 10*a* of the blade 10 extends from the body portion 18*c* to the upper side of the conical portion 18*d* of the rotor yoke 18, and the tip end of the inner periphery portion 10*a* on the inner periphery side reaches a part near the border between the conical portion 18*d* and the top plate portion 18*b*. A lower surface (surface opposite to the conical portion 18*d*) 10*b* of the inner periphery portion 10*a* of the blade 10 tilts along the conical portion 18*d*, from the body portion 18*c* toward the top plate portion 18*b*. A constant clearance t is formed between the lower surface 10*b* and an upper surface (part of the outer peripheral surface of the rotor yoke 18) 18*e* of the conical portion 18*d* of the rotor yoke 18.

The blades 10 are all formed in the same shape, and eleven blades 10, in this case, are arranged at equal intervals in the circumferential direction. The chord length of the blade 10 is about 30 mm, and about ⅓ of the chord length is the inner periphery portion 10*a* that overlaps with the upper surface 18*e* of the conical portion 18*d* of the rotor yoke 18. The lower surface 10*b* of the inner periphery portion 10*a* of the blade 10 is formed into a shape that follows the upper surface 18*e* of the conical portion 18*d*, that is, into a conical shape. For example, if the conical portion 18*d* is an outwardly protruding curved surface, the inner periphery portion 10*a* of the blade that overlaps therewith is formed into a similar curved surface corresponding therewith, so that the clearance t is kept constant.

The inner periphery portion 10*a* of the blade 10 is formed into a substantially triangular shape that gradually narrows toward the inner periphery side in side view, and is formed in a position higher than the outer periphery side of the blade 10. The height of the inner periphery portion 10*a* is set to substantially the same height as the top plate portion 18*b* of the rotor yoke 18. If the inner periphery portion 10*a* of the blade 10 is higher than the top plate portion 18*b*, air flowing in through the suction opening hits the protruding part and generates a vortex. This causes noise. Such a problem can be prevented in the present embodiment.

According to the centrifugal fan 1 of the present embodiment, by extending the inner periphery portion 10*a* of the blade 10 of the impeller 8 to the inner periphery side such that it overlaps with the upper surface 18*e* of the conical portion 18*d* of the rotor yoke 18 as described above, the chord length of the blade 10 can be made longer than when the inner periphery portion 10*a* is not extended in an impeller having the same outer diameter. The increase in the chord length of the blade 10 reduces load on the blade 10 during operation. Consequently, increase in noise can be suppressed even after thinning down the impeller 8, and therefore the entire fan can be thinned down. Additionally, since the chord length of the blade 10 is increased, capacity is increased efficiently, and the capacity property can be improved.

[3] Structure of Other Embodiments

Figure 6:
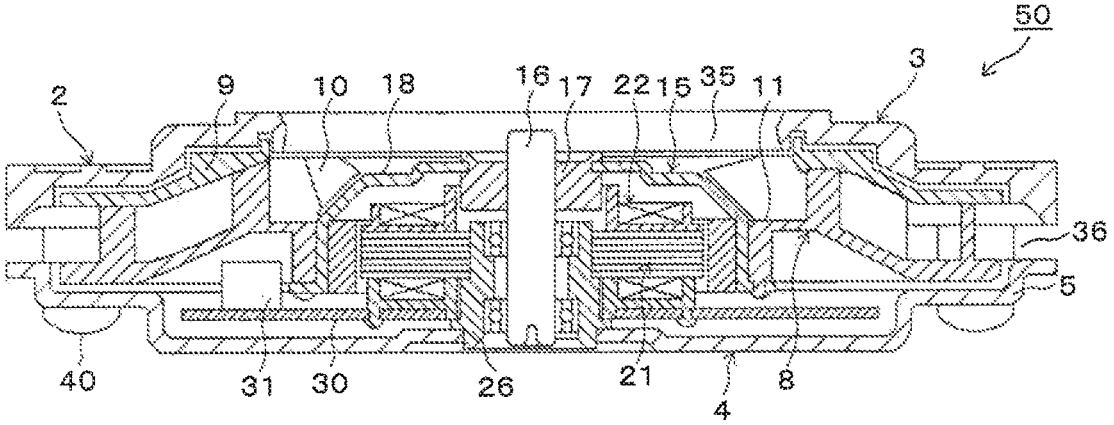
FIG. 6 is a cross-sectional view showing a modification of the centrifugal fan of an embodiment of the present disclosure.
Figure 7:
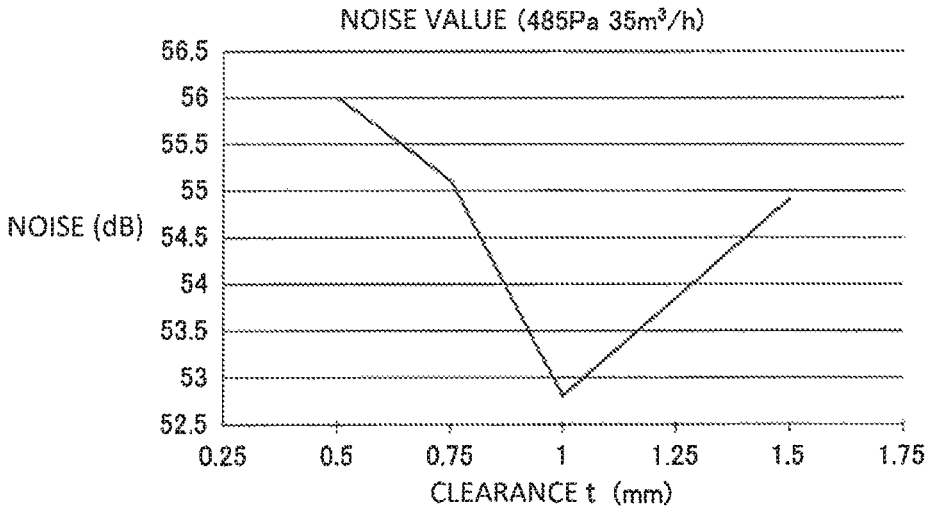
FIG. 7 is a diagram showing a relation between the clearance and noise in the embodiments in an example.
Figure 8:
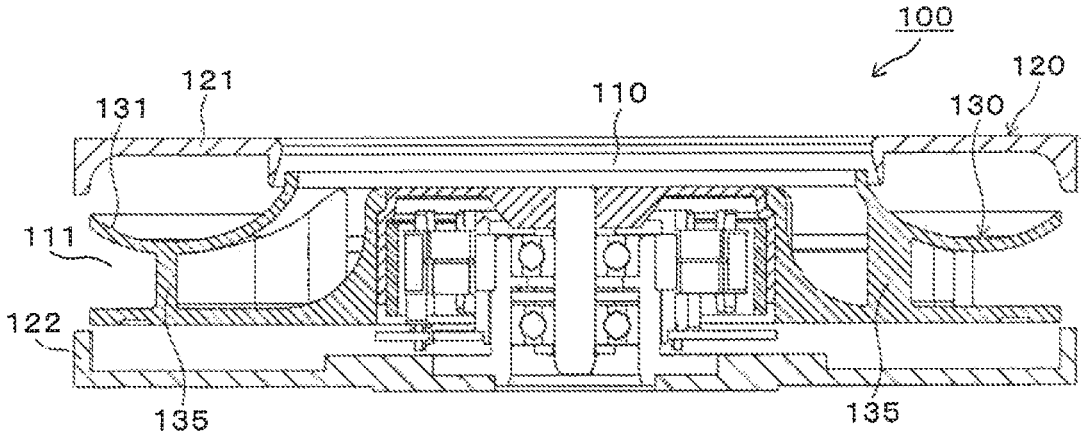
FIG. 8 is a cross-sectional view showing an example of a conventional centrifugal fan.

FIG. 6 shows a centrifugal fan 50 of a modification of the aforementioned centrifugal fan 1. While the lower casing 4 of the centrifugal fan 1 is configured by placing the motor base 5 formed by pressing a metal plate (e.g., a steel plate) and the resin base plate 6 on top of one another, a lower casing 4 of the centrifugal fan 50 of FIG. 6 is comprised only of a motor base 5 formed by pressing a metal plate (e.g., a steel plate). Other configurations are the same as the centrifugal fan 1, and the configuration of the inner periphery portion 10*a* of the blade 10 according to the present disclosure described in the above embodiment is also applied to the centrifugal fan 50. According to the centrifugal fan 50, by eliminating the resin base plate 6 and reducing the number of parts, cost can be reduced.

EXAMPLE (Verification of Appropriate Clearance t)

A centrifugal fan configured in the same manner as the centrifugal fan 1 of the above embodiment shown in FIGS. 1 to 5, and having a variable clearance t was made. Noise (dB) was measured by varying the clearance t between the lower surface 10*b* of the inner periphery portion 10*a* of the blade 10 and the upper surface 18*e* of the conical portion 18*d* of the rotor yoke 18, under a static pressure of 485 Pa, and an air flow of 35 $m^3$/h. The results are shown in FIG. 6.

As can be seen from FIG. 6, when the clearance t falls below 0.75 mm, there is no noise reduction effect. This is because viscosity of air having flowed into the casing through the suction opening forms a boundary layer on the outer peripheral surface (the upper surface 18*e* of the conical portion 18*d* in the above embodiment) of the rotor yoke, and a vortex is caused by separation of the boundary layer due to the gradient in velocity distribution at the suction opening.

Next, when the clearance t becomes larger than 0.75 mm, the noise reduction effect is achieved. When the clearance t is 1 mm, noise is reduced by about 3 dB from its level when the clearance t is 0.5 mm. This is because a jet is generated from air having flowed in through the suction opening, and the jet keeps a vortex from being generated by separation of the boundary layer on the outer peripheral surface of the rotor yoke. Hence, noise can be reduced. Moreover, when the clearance t exceeds 1 mm and becomes even larger, the amount of jet from the clearance t increases, and the flow of air to the outer periphery side of the blade is interrupted. This deteriorates the air-blowing performance, and tends to increase noise.

As is clear from FIG. 6, the size of the clearance t between the lower surface of the inner periphery portion of the blade and the outer peripheral surface of the rotor yoke affects the amount of noise, and a stronger noise reduction effect can be achieved when there is some clearance t, instead of 0, that is, no clearance t. It has been found that noise can be reduced effectively particularly when the clearance t is formed within a certain range such as 0.75 to 1.5 mm.

The present disclosure is particularly suitable for a centrifugal fan that needs to be slimmed down.

What is claimed is:

1. A centrifugal fan comprising:

a rotor that has a rotor yoke;

an impeller that has a blade and is coupled to the outer periphery of the rotor yoke;

a motor that rotates the rotor; and a casing that has a suction opening and a discharge opening, and houses the rotor, the impeller, and the motor, the impeller rotating together with the rotor discharging air sucked in through the suction opening to the outside of the casing through the discharge opening, wherein the rotor yoke has a top plate portion, a cylindrical body portion, and a conical portion connecting the top plate portion and the body portion, an inner periphery part of the blade on the rotor yoke side is formed so as to tilt along the conical portion on an outer peripheral surface of the rotor yoke, an inner periphery part of a surface of the blade extends to the inner periphery side, in such a manner as to overlap with the conical portion in an axial direction of the motor, and a certain clearance is formed between the inner periphery part of the blade and the conical portion of the rotor yoke.

2. The centrifugal fan according to claim 1, wherein the clearance is 0.75 to 1.5 mm.

3. The centrifugal fan according to claim 1, wherein the inner periphery part of the blade is substantially ⅓ of a chord length of the blade.

4. The centrifugal fan according to claim 1, wherein an axial height of the inner periphery part of the blade is substantially the same or lower than an axial height of the rotor yoke.

* * * * *